US009283728B2

(12) United States Patent
Kronseder

(10) Patent No.: US 9,283,728 B2
(45) Date of Patent: Mar. 15, 2016

(54) REMOVAL DEVICE FOR REMOVAL OF LABELS, LABEL AND METHOD FOR APPLYING GLUE TO A LABEL

(71) Applicant: Krones AG, Neutraubling (DE)

(72) Inventor: Volker Kronseder, Neutraubling (DE)

(73) Assignee: Krones AG, Neutraubling (DE)

( * ) Notice: Subject to any disclaimer, the term of this patent is extended or adjusted under 35 U.S.C. 154(b) by 200 days.

(21) Appl. No.: 13/835,025

(22) Filed: Mar. 15, 2013

(65) Prior Publication Data

US 2014/0178655 A1 Jun. 26, 2014

(30) Foreign Application Priority Data

Dec. 22, 2012 (DE) ..... 10 2012 113 077

(51) Int. Cl.

| | |
|---|---|
| ***B31D 1/02*** | (2006.01) |
| ***B65C 9/16*** | (2006.01) |
| ***B65C 9/22*** | (2006.01) |
| ***G09F 3/03*** | (2006.01) |
| ***G09F 3/10*** | (2006.01) |

(52) U.S. Cl.

CPC . *B31D 1/027* (2013.01); *B65C 9/16* (2013.01); *B65C 9/2282* (2013.01); *G09F 3/03* (2013.01); *G09F 3/10* (2013.01); *Y10T 428/24802* (2015.01); *Y10T 428/24851* (2015.01)

(58) Field of Classification Search

CPC ..... G09F 3/10; G09F 3/03; B65C 9/2282
See application file for complete search history.

(56) References Cited

U.S. PATENT DOCUMENTS 8,163,365 B2 * 4/2012 Weiner ..... B31D 1/021 428/201
2003/0047277 A1 3/2003 Bell et al.

FOREIGN PATENT DOCUMENTS

| | | | |
|---|---|---|---|
| DE | 1807524 | A1 | 5/1970 |
| DE | 2141306 | A1 | 5/1972 |
| DE | 3131164 | A1 | 2/1983 |
| DE | 3507739 | C1 | 4/1986 |
| DE | 4238189 | A1 | 5/1994 |
| DE | 3734640 | C2 | 6/1994 |
| JP | H 0811853 | A1 | 1/1996 |

OTHER PUBLICATIONS

Manual of Configuration Technology; Kronseder (Karl Dullinger publisher); Neutraubling 1985, p. 17, and English translation.
Manual of Configuration Technology; Kronseder (Karl Dullinger publisher); Neutraubling 1985, p. 81 and English translation.
Search report and English translation in corresponding app. No. DE 102012113077.9 dated May 7, 2013.

* cited by examiner

*Primary Examiner* — Xiao Zhao
(74) *Attorney, Agent, or Firm* — D. Peter Hochberg; Sean F. Mellino

(57) ABSTRACT

A removal device for removal of labels, a label and a method for applying glue to a label are provided. The removal device comprises a reception face for receiving glue. The reception face comprises a first region in which at least a first portion is arranged at at least a second portion for ensuring a sufficient glue application for a face of a label, to which face glue is applied. The first and second portions are configured so that glue can adhere to the first portion considerably easier than to the second portion, and at least a second region in which a third portion is arranged at a fourth portion for information purposes as regards the face of the label, to which face glue is applied. The third and fourth portions are configured so that glue can adhere to the third portion considerably easier than to the fourth portion.

9 Claims, 4 Drawing Sheets

REMOVAL DEVICE FOR REMOVAL OF LABELS, LABEL AND METHOD FOR APPLYING GLUE TO A LABEL

CROSS-REFERENCE TO RELATED APPLICATION

This application claims foreign priority based on German patent application DE 10 2012 113 077.9, filed on Dec. 22, 2012, the content of which is incorporated herein by reference in its entirety.

BACKGROUND OF THE INVENTION

1. Field of the Invention

The invention relates to a removal device for removal of labels, a label and a method for applying glue to a label.

2. Description of the Prior Art

In the art of labeling, glue is applied to labels as regards an application of wet glue. This applying of glue is implemented in the state of the art by a glue roller transferring glue to a reception face of a label carrier. The reception face has a form and a size substantially corresponding to the form and the size of the label to which glue is to be applied. After the transfer of the glue to the reception face, the reception face is subsequently moved along a label store so that a label adheres to the reception face due to the glue adhesive power and, thus, the label can be transferred to the label carrier. Subsequently, the labels are taken off the label carrier by means of grippers and are applied to the correspondingly provided bundle, as containers, in particular bottles, cans or the like. This technique is realized as regards all different label carrier types provided for the different label forms and label types, for example a neck label, a chest label, a waist label or a spine or back label of a container. DE 2 141 306 A1 discloses a removal device for labels, in which such an application of wet glue to labels is described.

Removal elements for labels in a labeling machine are known in the prior art, wherein the removal element is configured so that an application of glue does not have to be effected to the entire label. Thereby, saving of glue shall be achieved.

As needed it is required to accommodate information regarding features of a producer of the bundles and/or features of a manufacturer of the labeling machine and/or features of a client on the labels. However, this requires currently either an additional print onto the label or a change of the print template available for the label. Both alternatives require thus an additional method step. This is disadvantageous as regards the costs and/or the output of a labeling machine.

Moreover, due to increasing counterfeiting of merchandise, it is considered to design the labels fraud resistant. For this purpose, the front face of the labels can be designed accordingly with especially developed print methods. It is further possible to use special material for the labels to prohibit or at least confuse the issue of counterfeiting the labels. However, both possibilities are very elaborate and cost-intensive so that there is the need for an alternative.

SUMMARY OF THE PRESENT INVENTION

Thus, it is an object of the invention to provide a removal device for removal of labels, a label and a method for applying glue to a label, with which the above-mentioned problems can be solved. In particular, a removal device for removal of labels, a label and a method for applying glue to a label shall be provided, with which the label can be provided cost-efficiently with additional, free selectable information without causing that the velocity of the labeling machine is reduced and thereby the output of the labeling machine is diminished.

The object is solved by a removal device for removal of labels, wherein the removal device comprises a reception face for reception of glue, the reception face comprising a first region in which at least a first portion is arranged at at least a second portion for ensuring a sufficient glue application for a face of a label, to which face glue is to be applied, wherein the first and second portion are configured so that glue can adhere to the first portion considerably easier than to the second portion, and at least a second region in which a third portion is arranged at a fourth portion for information purposes as regards the face of the label, to which face glue is to be applied, wherein the third and fourth portion are configured so that glue can adhere to the third portion considerably easier than to the fourth portion.

In the removal device, the reception face is configured so that not the entire face contributes to the glue application, but there is provided at least an additional face region as a marking face. This additional face region can be used as advertising medium and/or as information medium without requiring a further method step.

With the additional marking face, additional information can be accommodated in the label. This information can be configured as water mark, for example. The marking can thus increase in an easy and cheap way the protection against forgery of the label.

Advantageous further developments of the removal device are given in the dependent claims.

At least one of the first or second or third or fourth portions can be dedicated to information purposes. Preferentially, at least one of the third or fourth portion is configured to form information fulfilling at least one of the following conditions, namely that the information contains advertising information or that the information relates to at least one of production or use of the object to be provided with the label. Therewith, the production chain of a bundle to be provided with a label can be retraced. Further, a promotion logo concerning a special festivity or an event or the like can be provided on the label.

Possibly, the third or fourth portion is configured to form at least one of at least one numeral or at least one letter or at least one figurative depiction.

According to one implementation form, the third or fourth portion can be configured as an elevation or as a recess of the reception face. According to another implementation form, the third portion can have a higher glue adhesive force than the fourth portion.

At least one of the first or second portions can concern various geometric formations, as for example grooves, honeycombs, ovals, coils, rings or various graphics.

It is also possible that at least one of the following conditions applies, namely that at least two faces of the second region adjoin the first region or that the first region surrounds the second region or that the second region can be accommodated freely arrangeable in the first region.

According to a further implementation form, the second region can be an exchangeable element removably arranged at the first region. Thereby, the labels can be provided very easy with different information.

Preferably, the exchangeable element is configured to build up a form closure with the first region.

It is also conceivable, that at least one of the following conditions applies, namely that at least two sides of further, that means more than two, regions adjoin the first region or that the first region surrounds the further regions or that the further regions can be accommodated freely arrangeable in the first region. In the same way, the single regions can be accommodated in one another.

The above-described removal device can be part of a label carrier table for a labeling machine for labeling an object.

Further, the above-described removal device can be part of a labeling machine for labeling an object. The object is preferably a transparent object, as for example a bundle or a glass container or a plastic container. The labeling machine can thus comprise a label carrier table which comprises the above-described removal device.

Possibly, the labeling machine further comprises a first glue reception container for reception of a first, for example a transparent, glue, and a second glue reception container for reception of a second, for example a colored, glue, wherein the labeling machine is configured so that the transparent glue is applicable to the first region and the colored glue is applicable to the second region or vice-versa. The use of more than two glue reception containers is conceivable, too, an that plural colors can be imaged on a label. It is further possible, to arrange plural glue chambers in one glue container so that different colors can be depicted therewith, as well.

The above-mentioned object is further solved by a method for applying glue to a label, the method comprising the steps of: applying glue to a reception face being part of a removal device for removal of labels, wherein the reception face comprises a first region in which at least a first portion is arranged at at least a second portion for ensuring a sufficient glue application for a face of a label, to which face glue is to be applied, wherein the first and second portion are configured so that glue can adhere to the first portion considerably easier than to the second portion, and a second region, in which a third portion is arranged at a fourth portion for information purposes as regards the face of the label, to which face glue is to be applied, wherein the third and fourth portion are configured so that glue can adhere to the third portion considerably easier than to the fourth portion and wherein the applying of glue is implemented in one method step.

The method achieves the same advantages as they are mentioned in respect of the removal device.

In the applying of the glue, transparent glue can be applied to the first region and colored glue can be applied to the second region or vice-versa.

The above-mentioned object is further solved by a label for labeling an at least partly transparent object. The label comprises a first back face region in which at least a first glue portion is arranged at at least a first back face portion so that a sufficient application of glue to the back face of the label is ensured, wherein considerably less glue adheres in the first back face portion than in the first glue portion, and a second back face region in which a second glue portion is arranged at a second back face portion for information purposes of the back face of the label, wherein considerably less glue adheres in the second back face portion than in the second glue portion.

Further, the above-mentioned object is solved by a bundle provided with a label that is produced with a method as described above.

Further possible implementations of the invention comprise also combinations or features or styles described above or in the following with reference to the embodiments, even if they are not explicitly mentioned. Herein, the person skilled in the art will also add single aspects as improvements or additions to the respective basic form of the invention.

BRIEF DESCRIPTION OF THE DRAWINGS

In the following, the invention is described in more detail by means of embodiments and with reference to the appended drawing Figures, wherein.

In the figures, the same or functionally same elements are provided with the same reference signs unless given otherwise.

DETAILED DESCRIPTION OF THE PRESENT INVENTION

Figure 1:
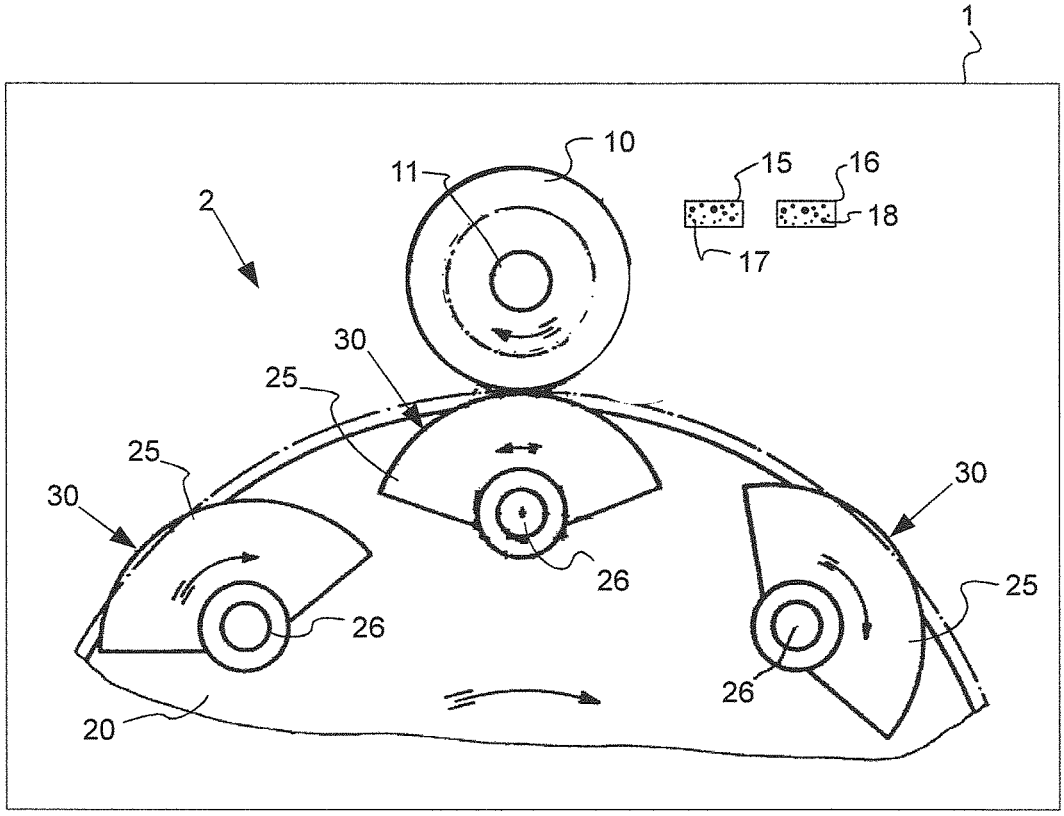
FIG. 1 shows a simplified top view of a labeling machine comprising plural removing devices according to a first embodiment.

FIG. 1 shows very schematically a labeling machine 1 with a label carrier table 2. At the label carrier table 2, a glue roller is arranged, which is driven around a roller mandrel 11 by a drive which is not shown and which can be configured as a servo motor or as direct drive, as well. The glue roller 10 can take glue 17, 18 out of at least one of a first glue accommodating container 15 or a second glue accommodating container 16 by means of a device which is not shown. The labeling machine 1 further comprises a rotatable removal device carrier 20 on which plural removal devices 25 are arranged which are pivoting about a removal device mandrel 26. Each of the removal devices 25 comprises a reception face 30.

For transferring the glue 17, 18 to below-mentioned labels of the labeling machine 1, the glue roller 10 rotates about the mandrel 11 thereof in the direction of the arrow depicted in FIG. 1 on the glue roller 10 and applies in succession the glue 17, 18 to the reception face 30 of the respective removal device 25. Thereafter, the removal devices 25 can be moved relative to a label storage, which is not shown, to produce eventually a label to which glue is applied in a known manner. The label to which glue is applied can be applied to an object, like for example a bundle, like containers, in particular bottles, cans, boxes, packaging units thereof or the like, by means of a gripper.

Figure 2:
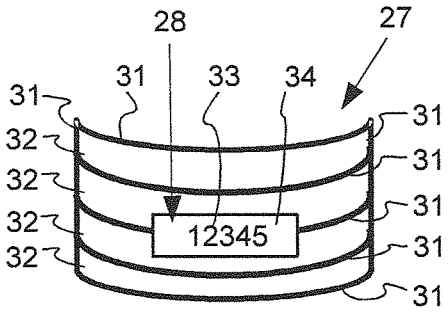
FIG. 2 shows a top view of a reception face of the removal device according to the first embodiment.

FIG. 2 shows the reception face 30 of a removal device 25 in more detail. The removal face 30 is a curved face corresponding in form and size substantially to the form and size of a label to which glue is to be applied by the reception face 30. The reception face 30 comprises first portions 31, second portions 32, a third portion 33 and a fourth portion 34. Herein, the first and second portions 31, 32 form a first region 27. The first region 27 surrounds a second region 28 formed by the third and fourth portions 33, 34.

The reception face 30 is preferably flexible. For example, the reception face 30 is made of a flexible material, in particular rubber, plastic, etc. In the present embodiment, the first portions 31 in FIG. 2 are implemented as an elevation of the reception face 30, whereas the second portions 32 are implemented as recess of the reception face 30. Moreover, the third portion 33 is implemented as an elevation of the reception face 30, whereas the fourth portion 34 is implemented as a recess of the reception face 30. The first portions 31 are arranged as bars arranged in parallel to each other, wherein the respective endings of the bars are terminated by a further first portion 31, as shown in FIG. 1. The first portions 31 are each arranged adjacent to the second portions 32. Herein, the second portions 32 are each arranged between the first portions 31. Due to this arrangement, the first and second portions 31, 32 form a groove pattern as shown in FIG. 2. Therewith, the first and second portions 31, 32 are altogether configured so that glue 17, 18 can adhere to the first portion 31 considerably easier than to the second portion 32.

In FIG. 2, the third portion 33 forms in the present embodiment a number consisting of four numerals. The third portion 33 is thus usable as a marking for the back face, which can also be referred to as the face to which glue is to be applied, of a label. For this purpose, the glue roller 10 of FIG. 1 is rolled off at the reception face 30 so that at least one of the glue 17 or 18 is applied preferably only to the first portions 31 and the third portion 33. Herein, no or little glue 17, 18 is applied to the second and fourth portion 32, 34.

Figure 3:
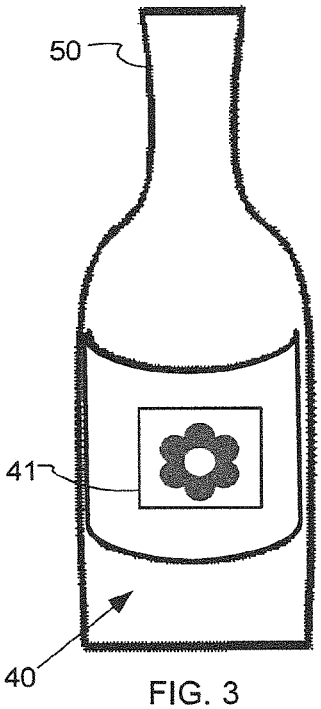
FIG. 3 shows a front view of a label according to the first embodiment, which label is applied to a bottle.

FIG. 3 shows the front face of a label 40 at the back face of which the reception face 30 of FIG. 2, to which glue 17, 18 is applied, was rolled off. Therewith, the label 40 could be applied to an object 50, like a bundle 50, in form of a bottle, as shown in FIG. 3. On the label 40 is printed on the front face thereof a label image 41, for example a flower. However, arbitrary other label images 41 are possible which can comprise at least one of graphical or scripture elements.

Figure 4:
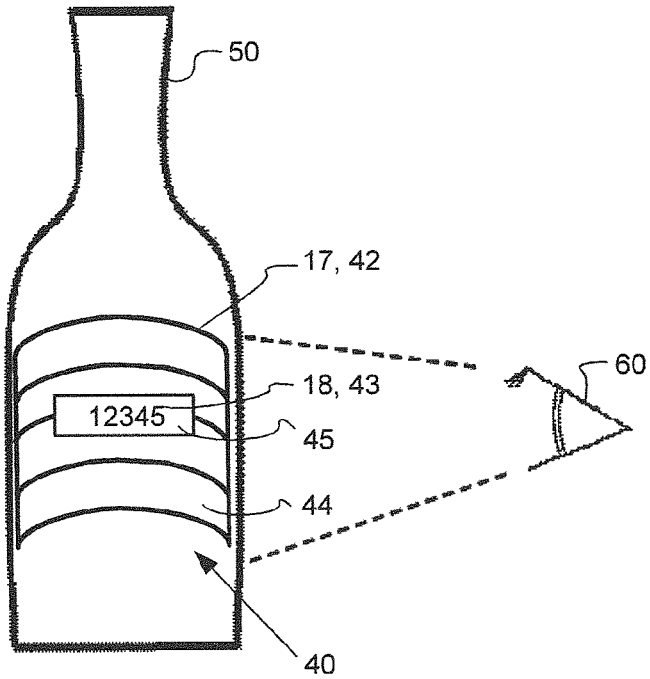
FIG. 4 shows a back view of a label according to the first embodiment, which label is applied to the bottle of FIG. 3.

FIG. 4 shows the back face of the label 40 in more detail. On the back face of the label 40, glue 17, 18 is applied to the label 40, as the glue 17, 18 was transferred from the reception face 30 of FIG. 2 to the label 40 in FIG. 3. Here traces of glue 17, 18 are present, which traces correspond to the first and third portions 31, 33 in FIG. 3. The horizontal traces of glue 17 in FIG. 4 correspond to the first glue portion 42 of the label 40. The traces of glue 18 in form of a marking in FIG. 4 correspond to a second glue portion 43 of the label 40. The portions in FIG. 4, which are provided little or not a bit with glue 17, 18, correspond to a first and a second back face portion 44, 45 of the label 40. For the sake of clear arrangement, not all of the portions 42 to 45 in FIG. 4 are provided with a reference sign. Therewith, both a gluing of the label 40 to the bundle 50 is realized and the marking on the back face of the label 40 by the second glue portion 43 is present. An observer, like a buyer of the bundle 50, for example, can recognize with his eye 60 the marking through the bundle 50 on the from now on inner face of the label 40 and can learn therefrom the information comprised therein. For this purpose, the bundle 50, in particular the wall thereof, is preferably configured transparent or with a transparent color. As approximately apparent from FIG. 3 and FIG. 4, the configuration of the label 40 corresponds in form and size to the form and size of the reception face 30 of FIG. 2.

By the above-described configuration of the reception face 30, the marking on the back face of the label 40 was provided by the third and fourth portion 33, 34 and was generated with a positive stamp.

As described above, the glue 17, 18 can be applied to the reception face 30 in only one method step in the present embodiment.

Figure 5:
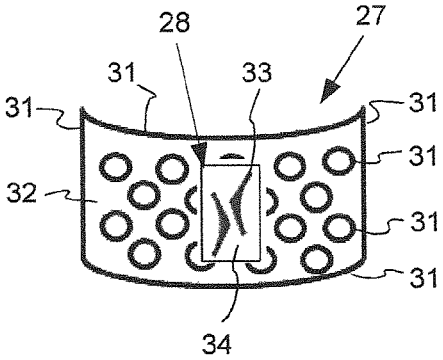
FIG. 5 shows a depiction of a reception face of a removal device according to a second embodiment.

FIG. 5 shows an example of the removal device 25 in which the third portion 33 is a logo, in particular a trademark logo. Further, the first and second portions 31, 32 form a honeycomb structure. In other respects the first to fourth portions 31 to 34 are implemented in the same manner as described in the first embodiment.

As a modification of at least one of the first or second embodiments, the third portion 33 can also be implemented as a recess and the fourth portion 34 can be implemented as an elevation. In this case, the marking on the back face of the label 40, which marking is provided by the third and fourth portions 33, 34, is generated with a negative stamp, whereas it is generated in each of the first and second embodiments as a positive stamp.

According to a further modification at least one of the first or second embodiments, the glue 17 in the first glue accommodating container 15 is a transparent glue, in particular wet glue. The glue 17 can also be cold glue or warm glue or dispersion glue. In contrast thereto, the glue 18 in the second glue accommodating container 16 is colored glue, in particular et glue made of transparent casein having at least one color pigment. Also, the glue 18 can be cold glue or warm glue or dispersion glue. Herein, the transparent glue 17 can be applied to the first portion 31 on the removal device 25, whereas the colored glue 18 can be applied to the third portion 33 on the removal device 30. Therewith, the marking according to the third and fourth portions 33, 34 is disposed in color as against the other region of the back face of the label 40. Generally, a specific glue type can be used to visualize the marking. It is also conceivable that the complete label 40, that means both the regions 27, 28 of the reception face 30 or both regions 42, 44 and 43, 45 of the back face of the label 40, is applied with colored or colorless glue.

Figure 6:
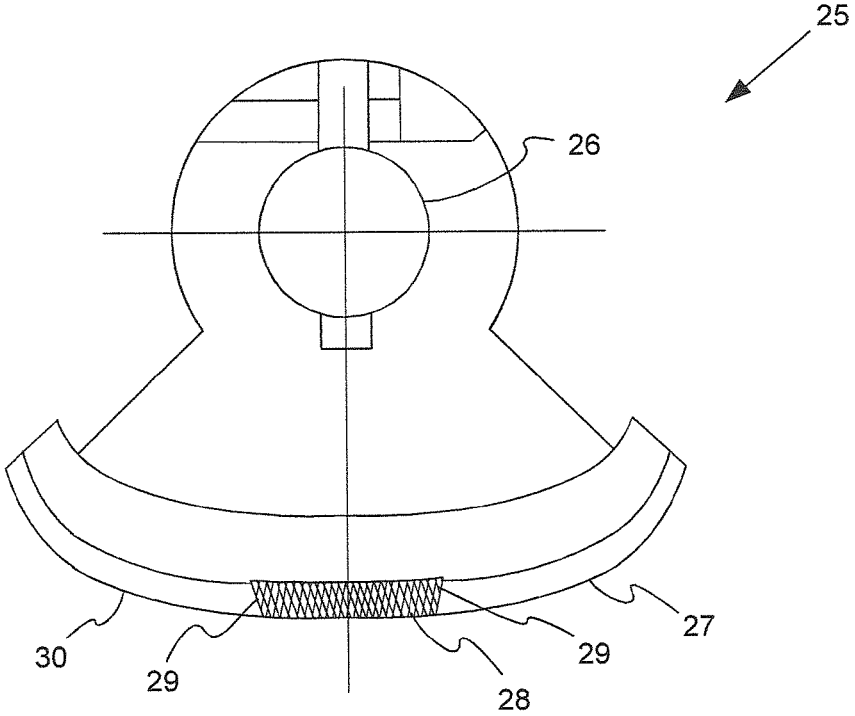
FIG. 6 shows a sectional view of a removal device according to a third embodiment.

FIG. 6 shows a removal device 25 according to a third embodiment in more detail in a section. The reception face 30 has a first region 27 and a second region 28. The first region 27 is arranged around the second region 28. Thus, the first region 27 surrounds the second region 28. In this embodiment, the second region 28 is implemented as an exchangeable element or pad. The second region 28 has at the sides thereof sloped edges 29. Thus, the second region 28 has the form of a truncated pyramid. The first region 27 is adapted at the edge thereof that adjoins the edges 29 to the form of the second region 28. Thus, in the arrangement shown in FIG. 6, the first region 27 and the second region 28 form a formed closure. Therewith, the second region 28 is securely held in the first region 27. However, the second region 28 can be removed easily out of the first region 27 in case this is desired. As the need may be, a suction belt can be used for this purpose.

Even if it is not shown in FIG. 6, the second region 28 comprises the third and fourth portions 33, 34, as described in the preceding embodiments. As a result, the removal device 25 can produce in the arrangement shown in FIG. 6 again a marking on the back face of a label 40, to which back face glue is applied, in the region of the second region 28. The second region 28 is however easily exchangeable for another second region 28 implemented as an exchangeable element or pad, as well. Consequently, it is possible to provide different markings, as necessary, on the back face of a label 40. The second region 28 can include an adjustment mark for the simplification of the mounting thereof.

Figure 7:
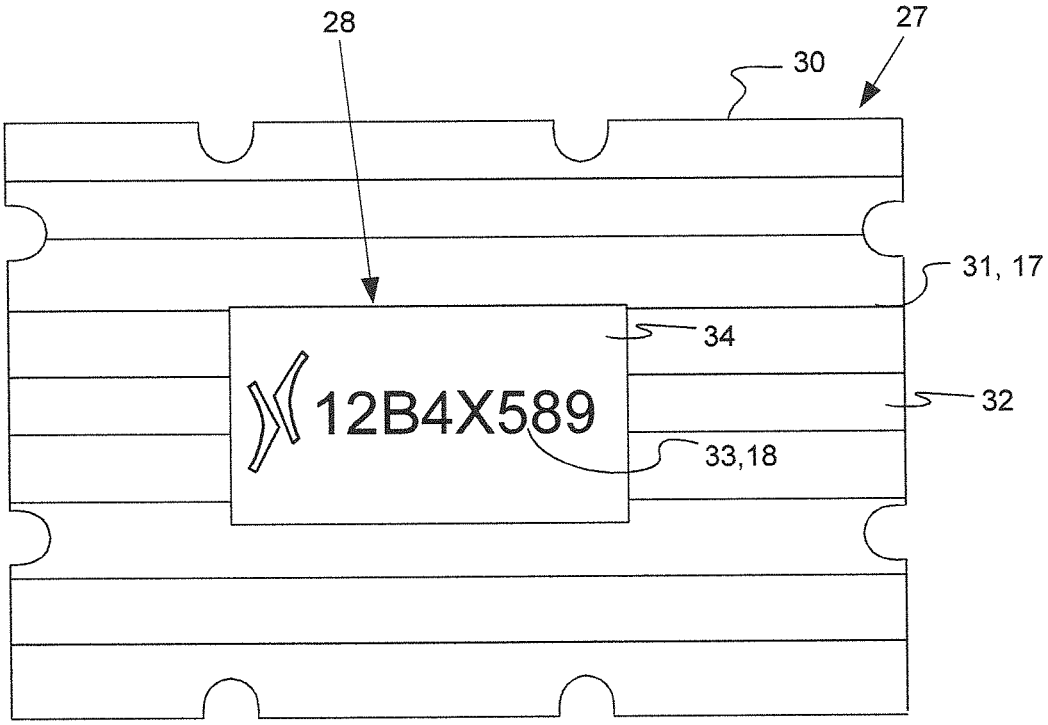
FIG. 7 shows a depiction of a reception face of a removal device according to the third embodiment.

FIG. 7 shows a reception face 30 in which to the first region 27 and to the second region 28 is applied glue so that a sufficient application of glue for the label 40 to which glue is to be applied is present in the first region 27 so that the label 40 can securely adhere to a bundle 50, as shown in FIG. 3 and FIG. 4, for example. In the first region 27, the glue 17 is applied laminar to the first portion 31, whereas in the second portion 32 no or little glue is applied. For the sake of clear depiction, not all of the glue stripes and second portions 32 are provided with a reference sign. In contrast hereto, the information is present in the second region 28 on the third portion 33 in cooperation with the fourth portion 34, wherein the information consists in the present example of an image in the form of a logo and a combination of numerals and letters.

In the present embodiment, glue 18 is applied to the third portion 33, whereas no or little glue is applied to the fourth portion 34.

Figure 8:
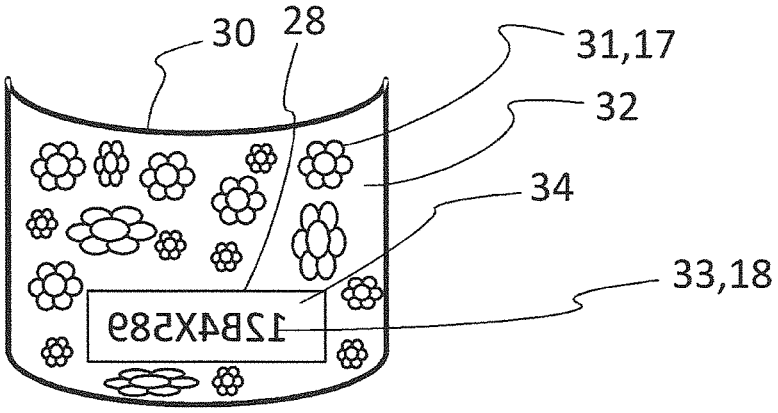
FIG. 8 shows a further depiction of a reception face of a removal device according to the third embodiment.

FIG. 8 shows a reception face 30 in which to the first region 27 and to the second region 28 is applied glue so that a sufficient application of glue for the label 40 to which glue is to be applied is present in the first region 27 so that the label 40 can securely adhere to a bundle 50, as shown in FIG. 3 and FIG. 4, for example. In the first region 27, the glue 17 is applied in graphic form to the first portion 31, whereas in the second portion 32 no or little glue is applied. As shown in the figure, the graphic portions can also be depictions of different occurrence, for example by means of at least one of form or size. In contrast thereto, the information is present in the second region 28 on the third portion 33 in cooperation with the fourth portion 34, wherein the information consists in the present example of a combination of numerals and letters. In the present embodiment, glue 18 is applied to the third portion 33, whereas no or little glue is applied to the fourth portion 34.

All of the above-described implementations of the labeling machine 1, the removal device 25 and the method can be used separately or in all possible combinations thereof. In particular, an arbitrary combination of the features of the above-described embodiments is possible. In addition, in particular, the following modifications are conceivable.

The elements shown in the figures are depicted schematically and can differ in the specific implementation from the forms shown in the figures provided that the above-described functions are ensured.

Concerning the reception face 30, the first portion 31 can have a high glue adhesive power whereas the second portion 32 has a low glue adhesive power. Also thereby, the first and second portions 31, 32 are configured so that glue 17, 18 can adhere considerably easier to the first portion 31 than to the second portion 32. Herein, the first portion 31 can be made at least at the surface thereof from aluminum, etc., for example. The second portion 32 can be made at least at the surface thereof of a glue-repellant material like glue-repellent plastic, in particular polytetrafluorethylene etc. Also thereby, it can be ensured that sufficient glue is applied to the back face of the label 40, that means the face of the label 40, to which glue is to be applied.

Concerning the reception face 30, also the third portion 33 can have a high glue adhesive power, whereas the fourth portion 34 has a low glue adhesive power. Also thereby, the third and fourth portions 33, 34 are configured so that glue 17, 18 can adhere considerably easier to the third portion 33 than to the fourth portion 34. Therewith, it can also be ensured that the back face of the label 40 is marked in the second region 28 in the same method step as applying glue to the first region 27. Thus, the second region 28 in which the third portion 33 having a high glue adhesive power is arranged adjacent to the fourth portion 34 having low glue adhesive power is suitable for marking of the face of the label 40 to which face glue is to be applied.

The marking on the back face of the label 40, which marking was produced with the third portion 33, can be a writing but an illustration or image presentation, too. It is thus possible, to provide individual, free selectable features of a producer of the bundle, like for example at least one of the machine line number or mark name or logo, in particular mark logo, etc., or individual, free selectable features of a producer of the labeling machine, like at least one of format part number or mark name or logo, in particular mark logo, etc., or the like on the removal device 30 and thus the label 40. The information relates therewith to a firm, taking part in the manufacturing of an object to be provided with a label.

In all of the implementation forms, the reception face 30 can also be applied only with the glue 17 or the glue 18.

The reception face 30 can be configured for all possible label types, like for example a neck label, a chest label, a waist label, a spine or back label of a container, etc. The surface of the reception face 30 can have a hardness of 45 Shore.

The first portion 27 can be configured, instead of a linear or honeycomb configuration, in an arbitrary other geometrical configuration.

The form closure of the first region 27 with the second region 28, as shown in FIG. 6, can be generated in another manner, too. The form closure can also be produced by a removable snap connection, for example.

The second region 28 does not have to adjoin the first region 27 as regards all of the sides of the second region 28. There can also be present a further marking region adjoining directly to the second region 28, so that at least one side of the second region 28 adjoins the first region. It is also possible that the second region 28 comes up to at least one edge of the label 40 to which glue is to be applied. In this case, the second portion 28 can also adjoin only two sides or part portions of the first region 27.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

What is claimed is:

1. A method for applying glue to a label using a removal device, the removal device having a reception face, the method comprising the step of:

applying glue to the reception face of the removal device for removing labels, wherein the step of applying glue is implemented in one method step;

the reception face comprising a first region in which at least a first portion is arranged at at least a second portion for ensuring a sufficient glue application for a face of a label, to which face glue is applied, wherein the first and second portions are configured for adhering glue to the first portion easier than to the second portion by fulfilling at least one of the following conditions, namely that the first or second portion is configured as a selected at least one of an elevation of the reception face, and a recess of the reception face, and wherein the first portion has a higher glue adhesive force than the second portion, and a second region, in which a third portion is arranged at a fourth portion for information purposes as regards the face of the label, to which face glue is to be applied, wherein the third and fourth portions are configured for adhering glue to the third portion easier than to the fourth portion by fulfilling at least one of the following conditions, namely that the third or fourth portion is configured as a selected at least one of an elevation of the reception face, and a recess of the reception face, and wherein the third portion has a higher glue adhesive force than the fourth portion.

2. The method according to claim 1, wherein the step of applying the glue comprises performing one of the steps consisting of applying transparent glue to the first region and colored glue to the second region, and applying colored glue to the first region and transparent glue to the second region.

3. The method according to claim 2, wherein the step of applying the glue is performed by a labeling machine, wherein said labeling machine comprises:

a first glue reception container for receiving a transparent glue, and a second glue reception container for receiving a colored glue, wherein the labeling machine is configured so that the transparent glue is applicable to the first region and the colored glue is applicable to the second region or that the colored glue is applicable to the first region and the transparent glue is applicable to the second region.

4. The method according to claim 1, wherein the removal device is part of a label carrier table of a labeling machine, and wherein the method further comprises the step of using the label carrier table to label an object.

5. The method according to claim 1, wherein the label for receiving glue is provided with advertising information or information relating to at least one of production or use of the object for receiving the label, and wherein at least one of the third or fourth portions forms information for fulfilling at least one of the conditions, that the information contains advertising information or that the information relates to at least one of production or use of the object to be provided with the label.

6. The method according to claim 1, wherein the third or fourth portion forms at least one selected from the group consisting of at least one numeral, at least one letter and at least one figurative depiction.

7. The method according to claim 1, wherein at least one of the following conditions applies, namely that a selected at least one of at least two faces of the second region adjoin the first region, that the first region surrounds the second region, and that the second region can be accommodated freely arrangeable in the first region.

8. The method according to claim 1, wherein the second region is an exchangeable element removably arranged at the first region.

9. The method according to claim 1, wherein the exchangeable element builds up a form closure with the first region.

* * * * *